US008896488B2

(12) United States Patent
Ayala Vazquez et al.

(10) Patent No.: US 8,896,488 B2
(45) Date of Patent: Nov. 25, 2014

(54) MULTI-ELEMENT ANTENNA STRUCTURE WITH WRAPPED SUBSTRATE

(75) Inventors: Enrique Ayala Vazquez, Watsonville, CA (US); Erik A. Uttermann, San Francisco, CA (US); Salih Yarga, Sunnyvale, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/038,300

(22) Filed: Mar. 1, 2011

(65) Prior Publication Data

US 2012/0223866 A1 Sep. 6, 2012

(51) Int. Cl.

| | |
|---|---|
| ***H01Q 1/24*** | (2006.01) |
| ***H01Q 1/38*** | (2006.01) |
| ***H01Q 5/00*** | (2006.01) |
| ***H01Q 9/42*** | (2006.01) |
| ***H01Q 21/28*** | (2006.01) |

(52) U.S. Cl.

CPC ..... *H01Q 1/243* (2013.01); *H01Q 1/38* (2013.01); *H01Q 5/0062* (2013.01); *H01Q 9/42* (2013.01); *H01Q 21/28* (2013.01)

USPC ..... 343/702

(58) Field of Classification Search

None

See application file for complete search history.

(56) References Cited

U.S. PATENT DOCUMENTS

| | | | | |
|---|---|---|---|---|
| 4,546,357 | A * | 10/1985 | Laughon et al. | 343/702 |
| 5,917,450 | A | 6/1999 | Tsunekawa et al. | |
| 6,124,831 | A | 9/2000 | Rutkowski et al. | |
| 6,285,324 | B1 | 9/2001 | Korisch et al. | |
| 6,456,250 | B1 * | 9/2002 | Ying et al. | 343/702 |
| 6,664,931 | B1 | 12/2003 | Nguyen et al. | |
| 6,937,192 | B2 | 8/2005 | Mendolia et al. | |
| 7,383,067 | B2 * | 6/2008 | Phillips et al. | 455/575.1 |
| 2004/0116157 | A1 | 6/2004 | Vance et al. | |
| 2004/0263403 | A1 | 12/2004 | Zafar et al. | |
| 2007/0109204 | A1 * | 5/2007 | Phillips et al. | 343/702 |
| 2008/0316121 | A1 * | 12/2008 | Hobson et al. | 343/702 |
| 2009/0051611 | A1 | 2/2009 | Shamblin et al. | |
| 2009/0058735 | A1 | 3/2009 | Hill et al. | |

(Continued)

FOREIGN PATENT DOCUMENTS

| | | |
|---|---|---|
| CN | 101958460 | 1/2011 |
| EP | 2065971 | 6/2009 |

(Continued)

OTHER PUBLICATIONS

Pance, Aleksander, et al. U.S. Appl. No. 12/861,640, filed Aug. 23, 2010.

*Primary Examiner* — Graham Smith

(74) *Attorney, Agent, or Firm* — Treyz Law Group; G. Victor Treyz; Michael H. Lyons

(57) ABSTRACT

Antennas are provided for electronic devices such as portable computers. Multiple resonating elements may be formed on a flexible antenna resonating element substrate. The flexible antenna resonating element substrate may have a first antenna resonating element at one end and a second antenna resonating element at an opposing end. The flexible antenna resonating substrate may be wrapped around a dielectric carrier and mounted within an electronic device under an inactive display region and above a dielectric housing window. Conductive structures such as conductive housing structures may form antenna ground. The resonating elements and antenna ground may form first and second antennas. A parasitic antenna resonating element may form part of the first antenna.

20 Claims, 8 Drawing Sheets

(56) References Cited

U.S. PATENT DOCUMENTS

| | | | |
|---|---|---|---|
| 2010/0127938 | A1 | 5/2010 | Ali et al. |
| 2010/0321253 | A1 | 12/2010 | Ayala Vazquez et al. |
| 2011/0012790 | A1 | 1/2011 | Badaruzzaman et al. |
| 2011/0012794 | A1 | 1/2011 | Schlub et al. |
| 2011/0134014 | A1 | 6/2011 | Kondo et al. |

FOREIGN PATENT DOCUMENTS

| | | |
|---|---|---|
| JP | 2001148603 | 5/2001 |
| JP | 2006217026 | 8/2006 |
| JP | 2008193299 | 8/2008 |
| JP | 2010531574 | 9/2010 |
| WO | 0231912 | 4/2002 |
| WO | 02078123 | 10/2002 |
| WO | 2007036610 | 4/2007 |
| WO | 2009002575 | 12/2008 |
| WO | 2010123733 | 10/2010 |
| WO | 2011013438 | 2/2011 |
| WO | 2011018551 | 2/2011 |

* cited by examiner

MULTI-ELEMENT ANTENNA STRUCTURE WITH WRAPPED SUBSTRATE

BACKGROUND

This relates generally to antennas, and, more particularly, to antennas for electronic devices.

Electronic devices such as portable computers and handheld electronic devices are often provided with wireless communications capabilities. For example, electronic devices may use long-range wireless communications circuitry such as cellular telephone circuitry and short-range communications circuitry such as wireless local area network communications circuitry. Some devices are provided with the ability to receive other wireless signals such as Global Positioning System signals.

It can be difficult to incorporate antennas successfully into an electronic device. Some electronic devices are manufactured with small form factors, so space for antennas is limited. In many electronic devices, the presence of electronic components in the vicinity of an antenna serves as a possible source of electromagnetic interference. Antenna operation can also be disrupted by nearby conductive structures. Considerations such as these can make it difficult to implement an antenna in an electronic device that contains conductive housing walls or other conductive structures that can potentially block radio-frequency signals.

It would therefore be desirable to be able to provide improved antennas for wireless electronic devices.

SUMMARY

Antennas may be provided for electronic devices such as portable computers. A flexible antenna resonating element substrate may be wrapped around a dielectric carrier. The dielectric carrier may have first and second opposing surfaces that are covered by the wrapped substrate. The first surface may be a planar surface that is mounted against a display cover glass layer. The second surface may be a curved surface having a shape that matches a curved dielectric antenna window shape in a curved portion of the housing of an electronic device.

The flexible antenna resonating element substrate may have a first antenna resonating element at one end and a second antenna resonating element at an opposing end. Conductive structures such as conductive housing structures may form antenna ground. The first antenna resonating element and the antenna ground may form a first antenna such as a cellular telephone antenna or other suitable antenna.

The second antenna resonating element and the antenna ground may form a second antenna such as a satellite navigation system antenna or other suitable antenna.

A parasitic antenna resonating element may form part of the first antenna. The first antenna may be configured to operate in first and second communications bands. The parasitic antenna resonating element may be used to ensure that the antenna covers the second communications band.

Further features of the invention, its nature and various advantages will be more apparent from the accompanying drawings and the following detailed description of the preferred embodiments.

DETAILED DESCRIPTION

Figure 1:
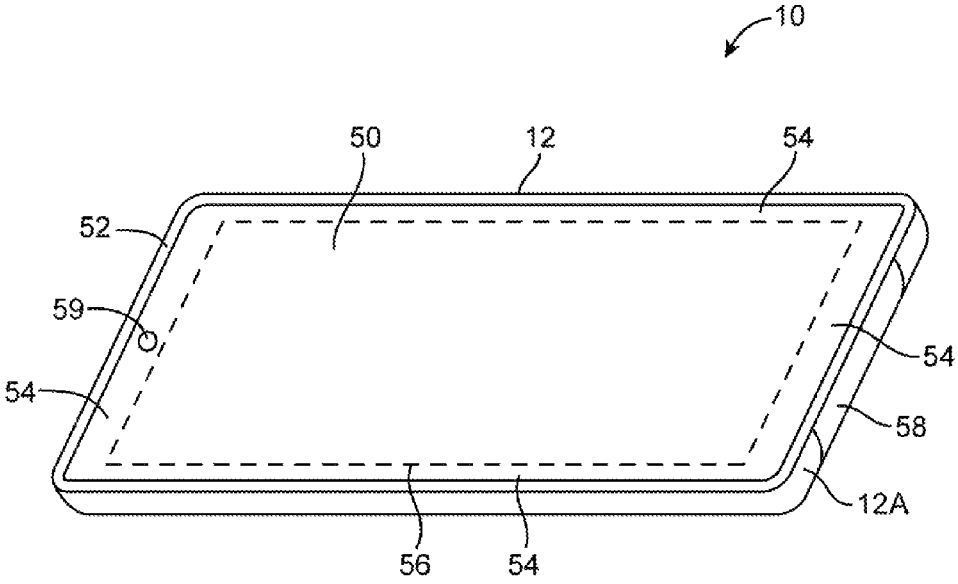
FIG. 1 is a front perspective view of an illustrative electronic device with antennas in accordance with an embodiment of the present invention.

Electronic devices may be provided with wireless communications circuitry. The wireless communications circuitry may be used to support wireless communications in one or more wireless communications bands. For example, the wireless communications circuitry may transmit and receive signals in cellular telephone bands and other communications bands and may receive wireless signals in satellite navigation system bands.

Space is at a premium in electronic devices such as portable electronic devices. Housings for these devices are sometimes constructed from conductive materials that block antenna signals. Arrangements in which antenna structures are formed behind a dielectric antenna window can help address these challenges. A dielectric window may be formed within an opening in the conductive housing wall. If desired, wireless signals can also be accommodate by forming all or most of an electronic device housing from a dielectric such as plastic. In some configurations, wireless signals can pass through dielectric structures such as the cover glass layers associated with a display. These configurations, other configurations for accommodating wireless signals in a device, or combinations of these configurations may be used in a wireless electronic device if desired.

Antenna resonating elements for antennas may be formed in the vicinity of an antenna window and under a portion of a display cover layer. Portions of a conductive housing or other conductive structures may serve as antenna ground. The antenna can be fed using a positive antenna feed terminal that is coupled to the antenna resonating element and a ground antenna feed terminal that is coupled to the conductive housing. During operation, radio-frequency signals for the antenna can pass through the antenna window and other non-conducting housing structures such as part of the cover glass.

The antennas may be formed from antenna resonating elements and conductive portions of the housing or other conductive structures that serve as antenna ground. The antenna resonating elements may be formed from conductive traces on a dielectric substrate. The conductive traces may be formed from copper or other metals. The dielectric substrate may be, for example, a flexible printed circuit. Flexible printed circuits, which are sometimes referred to as flex circuits, have conductive traces formed on a flexible dielectric substrate such as sheets of polyimide or other polymers.

The antenna resonating element substrate may be mounted on a support structure. For example, a flexible antenna resonating element substrate that includes multiple antenna resonating elements for multiple antennas may be wrapped around a dielectric carrier such as a molded plastic carrier or other plastic support structure. Wrapping the antenna resonating substrate around the carrier in this way allows the antennas to be efficiently mounted within a small available housing volume.

Antenna structures with configurations such as these can be mounted on any suitable exposed portion of a portable electronic device. For example, antennas can be provided on the front or top surface of the device. In a tablet computer, cellular telephone, or other device in which the front of the device is all or mostly occupied with conductive structures such as a touch screen display, it may be desirable to form at least part of the antenna window on a rear device surface. Other configurations are also possible (e.g., with antennas mounted in more confined locations, on device sidewalls, etc.). The use of antenna mounting locations in which at least part of a dielectric antenna window is formed in a conductive rear housing surface is sometimes described herein as an example, but, in general, any suitable antenna mounting location may be used in an electronic device if desired.

An illustrative portable device that may include antenna structures with resonating element substrates that are wrapped around a carrier is shown in FIG. 1. In general, devices such as device 10 of FIG. 1 may be any suitable electronic devices with wireless communications capabilities such as desktop computers, portable computers such as laptop computers and tablet computers, handheld electronic devices such as cellular telephones, smaller portable electronic devices such as wrist-watch devices, pendant devices, headphone devices, and earpiece devices, or other wearable or miniature devices.

As shown in FIG. 1, device 10 may be a relatively thin device such as a tablet computer. Device 10 may have display such as display 50 mounted on its front (top) surface. Housing 12 may have curved portions that form the edges of device 10 and a relatively planar portion that forms the rear surface of device 10 (as an example).

Housings with straight sidewalls and other configurations may also be used. The front surface of device 10 (i.e., the cover of display 50) may sometimes be referred to as forming the front housing surface of device 12.

The cover of display 50 may be formed from a layer of cover glass, a layer of plastic, or other materials. The cover layer for display 50 may be radio transparent in its inactive edge region (i.e., away from the conductive portions of the display that include active pixel circuits). As a result, radio-frequency signals may be received by antenna structures that are mounted under an edge portion of the display cover layer and may be transmitted from the antenna structures through the edge portion of the display cover layer. In configurations in which housing 12 is formed form a metal or other conductive material, a dielectric window such as dielectric window 58 may be formed in housing 12. Antenna structures for device 10 may be formed in the vicinity of dielectric window 58, so that radio-frequency antenna signals can pass through dielectric window 58 in addition to or instead of passing through the edge portions of the display cover layer.

Device 10 may have user input-output devices such as button 59. Display 50 may be a touch screen display that is used in gathering user touch input. Capacitive touch sensors or other touch sensors for the display may be implemented using a touch panel that is mounted under a planar cover glass member on the surface of display 50, may be integrated onto the cover glass layer, or may be otherwise incorporated into display 50.

The central portion of display 50 (shown as region 56 in FIG. 1) may be an active region that is sensitive to touch input and that is used in displaying images to a user using an array of image pixels (e.g., liquid crystal display image pixels, organic light-emitting diode image pixels, or other display pixels). The peripheral regions of display 50 such as regions 54 may be inactive regions that are free from touch sensor electrodes and image pixels. A layer of material such as an opaque ink may be placed on the underside of display 50 in peripheral regions 54 (e.g., on the underside of the cover glass). This layer may be transparent to radio-frequency signals. The conductive touch sensor electrodes in region 56 and the conductive structures associated with the array of image pixels in the display may tend to block radio-frequency signals. However, radio-frequency signals may pass through the cover glass and opaque ink in inactive display regions 54 (as an example). Radio-frequency signals may also pass through antenna window 58.

Housing 12 may be formed from one or more structures. For example, housing 12 may include an internal frame and planar housing walls that are mounted to the frame. Housing 12 may also be formed from a unitary block of material such as a cast or machined block of aluminum. Arrangements that use both of these approaches may also be used if desired.

Housing 12 may be formed of any suitable materials including plastic, wood, glass, ceramics, metal, or other suitable materials, or a combination of these materials. In some situations, portions of housing 12 may be formed from a dielectric or other low-conductivity material, so as not to disturb the operation of conductive antenna elements that are located in proximity to housing 12. In other situations, housing 12 may be formed from metal elements. An advantage of forming housing 12 from metal or other structurally sound conductive materials is that this may improve device aesthetics and may help improve durability and portability.

With one suitable arrangement, housing 12 may be formed from a metal such as aluminum or stainless steel. Portions of housing 12 in the vicinity of antenna window 58 may serve as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved surface.

Figure 2:
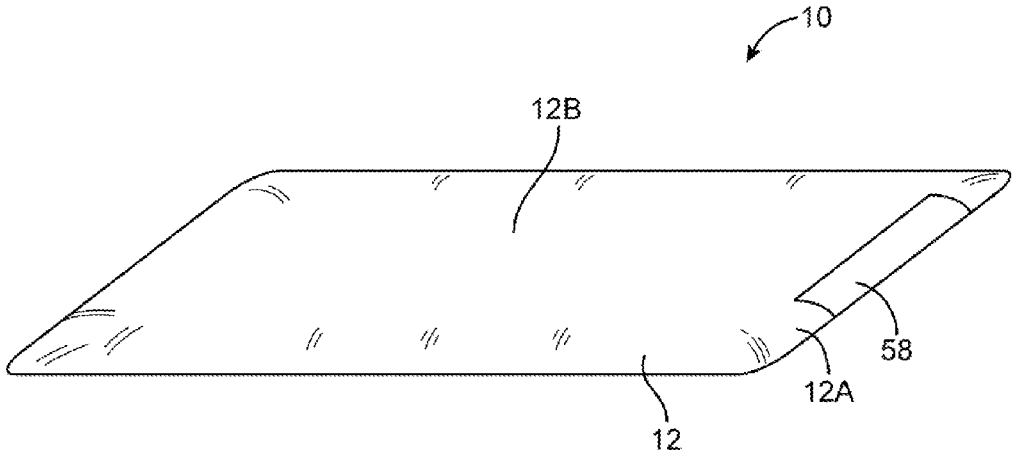
FIG. 2 is a rear perspective view of an illustrative electronic device with antennas in accordance with an embodiment of the present invention.

FIG. 2 is a rear perspective view of device 10 of FIG. 1 showing how device 10 may have a relatively planar rear surface 12B and showing how dielectric antenna window 58 may be rectangular in shape with curved portions that match the shape of curved housing edges 12A (as an example).

Figure 3:
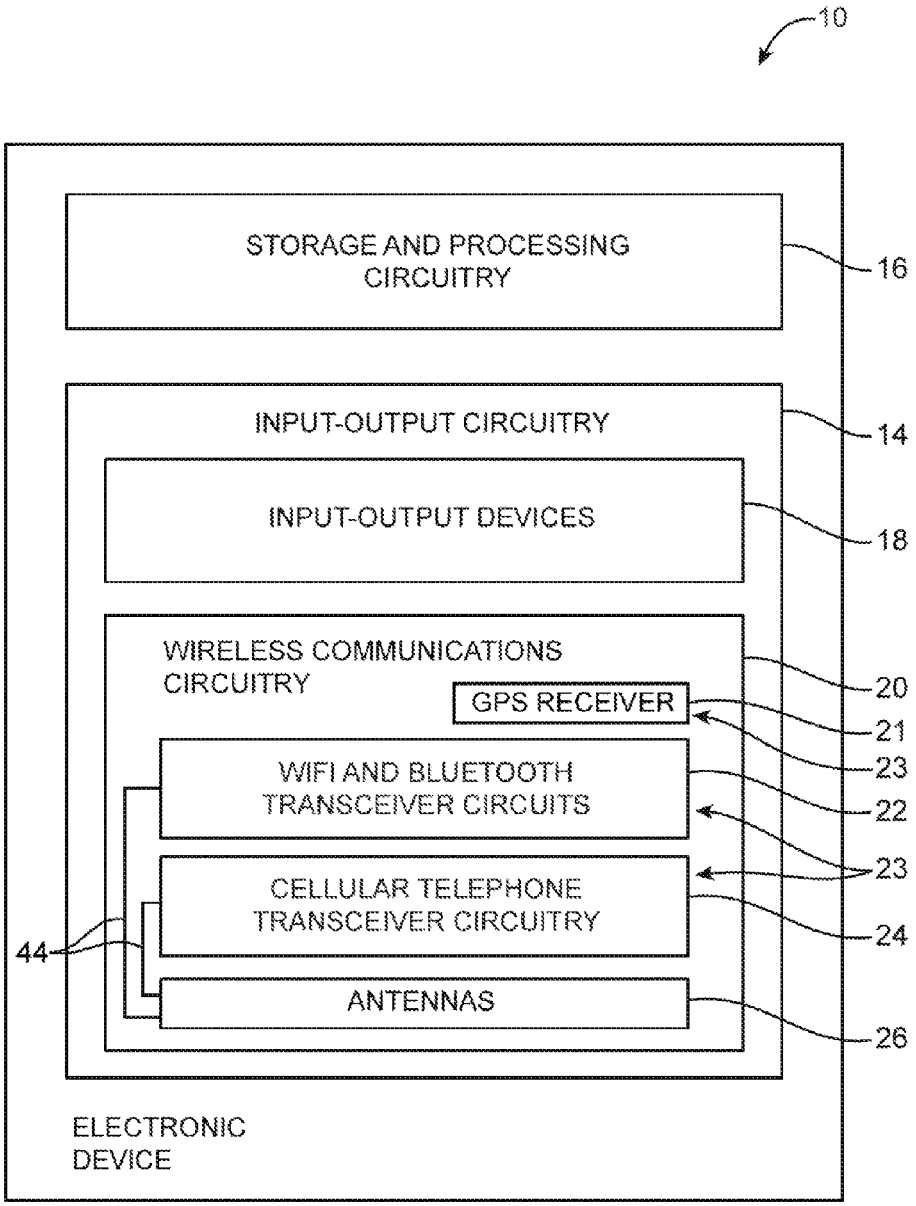
FIG. 3 is a schematic diagram of an illustrative electronic device with antennas in accordance with an embodiment of the present invention.

A schematic diagram of device 10 showing how device 10 may include one or more antennas 26 and transceiver circuits that communicate with antennas 26 is shown in FIG. 3. As shown in FIG. 3, electronic device 10 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, control functions for controlling radio-frequency power amplifiers and other radio-frequency transceiver circuitry, etc. Storage and processing circuitry 16 may be used in implementing suitable communications protocols. Communications protocols that may be implemented using storage and processing circuitry 16 include internet protocols, cellular telephone protocols, wireless local area network protocols (e.g., IEEE 802.11 protocols—sometimes referred to as WiFi®), protocols for other short-range wireless communications links such as the Bluetooth® protocol, etc.

Input-output circuitry 14 may be used to allow data to be supplied to device 10 and to allow data to be provided from device 10 to external devices. Input-output devices 18 such as touch screens and other user input interface are examples of input-output circuitry 14. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry 23 formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 20 may include radio-frequency transceiver circuits for handling multiple radio-frequency communications bands. For example, circuitry 23 may include transceiver circuitry 22 that handles 2.4 GHz and 5 GHz bands for WiFi (IEEE 802.11) communications and the 2.4 GHz Bluetooth communications band. Circuitry 23 may also include cellular telephone transceiver circuitry 24 for handling wireless communications in cellular telephone bands such as the bands at 850 MHz, 900 MHz, 1800 MHz, and 1900 MHz, and 2100 MHz band (as examples). Wireless communications circuitry 20 can include circuitry for other short-range and long-range wireless links if desired. For example, transceiver circuitry 23 may include global positioning system (GPS) receiver equipment 21, wireless circuitry for receiving radio and television signals, paging circuits, etc. In WiFi and Bluetooth links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26 such as an antenna or antennas located adjacent to antenna window 58 and under the inactive peripheral portion 54 of display 50. Antennas 26 may be single band antennas that each cover a particular desired communications band or may be multiband antennas. A multiband antenna may be used, for example, to cover multiple cellular telephone communications bands. If desired, a dual band antenna may be used to cover two WiFi bands (e.g., 2.4 GHz and 5 GHz). A single band antenna may be used to receive satellite navigation system signals such as Global Positioning System signals at 1575 MHz (as an example). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Transmission line paths 44 may be used to convey radio-frequency signals between transceivers 23 and antennas 26. Radio-frequency transceivers such as radio-frequency transceivers 23 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 44 may be used to interconnect the transceiver integrated circuits and other components on the printed circuit board with antenna structures in device 10. Paths 44 may include any suitable conductive pathways over which radio-frequency signals may be conveyed including transmission line path structures such as coaxial cables, microstrip transmission lines, etc.

Antennas 26 may, in general, be formed using any suitable antenna types. Examples of suitable antenna types for antennas 26 include antennas with resonating elements that are formed from patch antenna structures, inverted-F antenna structures, closed and open slot antenna structures, loop antenna structures, monopoles, dipoles, planar inverted-F antenna structures, hybrids of these designs, etc. With one suitable arrangement, which is sometimes described herein as an example, part of housing 12 (e.g., the portion of housing 12 in the vicinity of antenna window 58) may form a ground structure for the antenna associated with window 58. Antenna ground structures may also be formed from conductive traces on printed circuit boards, internal housing members such as frame members and structural internal housing plates, conductive portions of components such as connectors, and other conductive structures.

Figure 4:
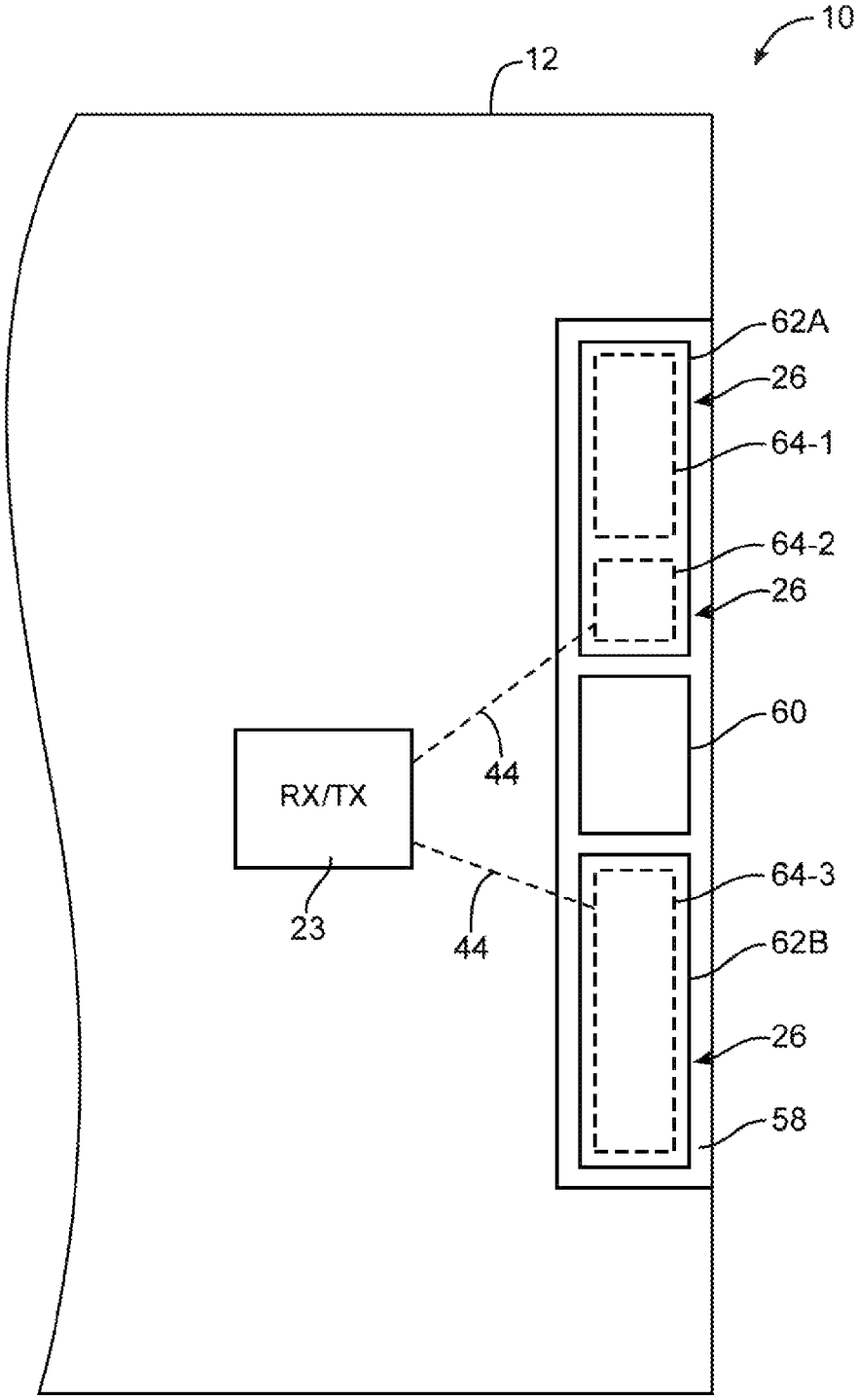
FIG. 4 is a rear view of an illustrative electronic device having antennas in accordance with an embodiment of the present invention.

A rear view of electronic device 10 in the vicinity of dielectric window 58 is shown in FIG. 4. As shown in FIG. 4, antennas 26 may each include an antenna resonating element and an antenna ground. In the example of FIG. 4, antenna resonating element substrate 62A includes antenna resonating element 64-1 and antenna resonating element 64-1. Antenna resonating elements 64-1 and 64-2 may be formed form patterned conductor such as patterned copper, gold, or other metals. Substrate 62A may be formed from a flex circuit substrate such as a sheet of polyimide or another flexible polymer sheet. In conjunction with nearby conductive structures such as portions of housing 12 or other ground structures that serve as antenna ground, antenna resonating elements 64-1 and 64-2 form respective first and second antennas 26.

At the lower portion of antenna window 58 in the example of FIG. 4, antenna resonating element 64-3 on antenna resonating element substrate 62B may form another antenna 26 such as another cellular telephone antenna. Substrate 62B may be, for example, a flex circuit substrate and antenna resonating element 64-3 may be formed using a patterned metal trace on the flex circuit substrate. Components 60 such as a camera or other electronic component for device 10 may be interposed been substrates 62A and 62B.

With one suitable arrangement, the antenna formed from antenna resonating element 64-3 may serve as a primary cellular telephone antenna for device 10 and antenna resonating element 64-1 may serve as a secondary cellular telephone antenna for device 10. The antenna formed from antenna resonating element 64-2 may serve as a satellite navigation system antenna such as a Global Positioning System antenna. This is merely illustrative. Antenna resonating elements 64-1, 64-2, and 64-3 and, if desired, additional antenna resonating elements in device 10 may be used in forming any suitable types of antennas.

Antennas 26 may be connected to transceiver circuitry 23 (e.g., cellular telephone transceiver circuitry, satellite navigation system receiver circuitry, etc.) using transmission line paths 44.

Figure 5:
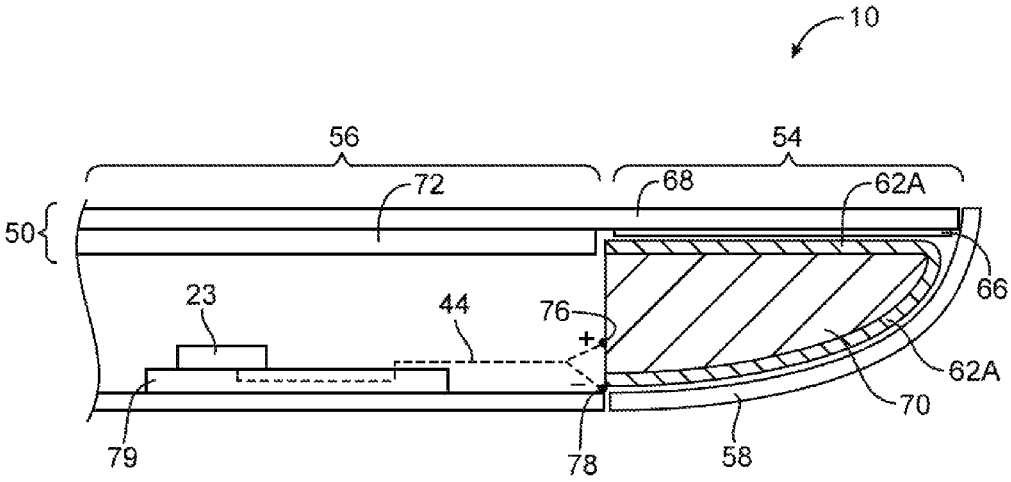
FIG. 5 is a cross-sectional side view of an illustrative electronic device with antennas in accordance with an embodiment of the present invention.

A cross-sectional side view of housing 12 of device 10 showing how antenna resonating element substrate 62A may be mounted under the surface of cover glass layer 68 in display 50 is shown in FIG. 5. As shown in FIG. 5, display 50 may include a display module (e.g., a liquid crystal display module or an organic light-emitting display module such as module 72 in active area 56). In inactive area 54, a layer of opaque material 66 such as black ink may hide antenna resonating element substrate 62A from view by a user of device 10.

The antenna resonating elements on substrate 62A (i.e., antenna resonating elements 64-1 and 64-2 of FIG. 4) may be fed using respective antenna feeds and may form respective first and second antennas. FIG. 5 shows how each transmission line 44 in device 10 may have be coupled to a respective antenna using a respective antenna feed that has a positive antenna feed terminal such as terminal 76 and a ground antenna feed terminal such as terminal 78. Positive antenna feed terminals 76 may be coupled to traces on the antenna resonating element substrates. Ground antenna feed terminals may be coupled to conductive antenna ground structures such as housing structure 12. Transmission lines 44 may couple feed terminals 76 and 78 to radio-frequency transceiver circuitry 23 on printed circuit board 79.

Antenna resonating element substrate 62A may be wrapped around a dielectric carrier such as carrier 70. Carrier 70 may be formed from any suitable dielectric material (e.g., a plastic such as a liquid crystal polymer or other suitable dielectric). In housing configurations of the type shown in FIG. 5 in which a portion of the housing (i.e., antenna window 58) is curved, carrier 70 may have opposing planar and curved surfaces. The planar upper surface of carrier 70 may be mounted against the planar inner surface of display cover glass 68. The curved lower surface of carrier 70 may be mounted against the mating curved surface of dielectric window 58. In housings with other shapes, other suitable configurations for carrier 70 may be used if desired. Antenna resonating element substrate 62A may, if desired, be attached to carrier 70 using adhesive (e.g., pressure sensitive adhesive).

Figure 6:
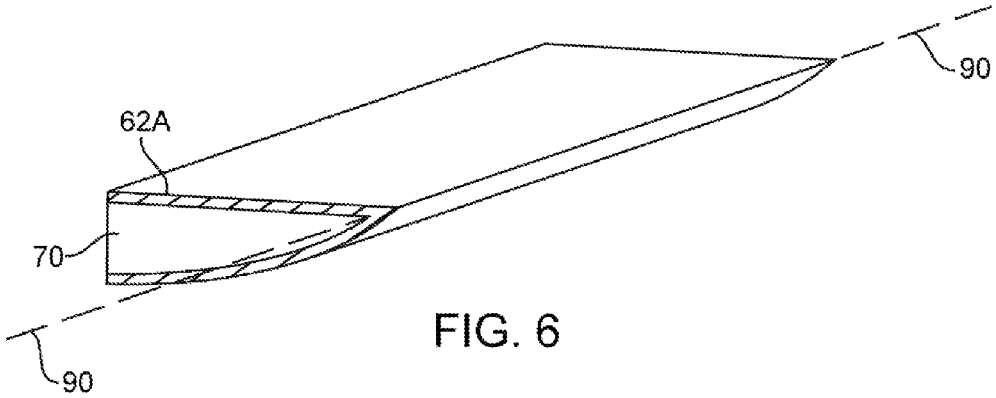
FIG. 6 is a perspective view of an antenna resonating element substrate wrapped around a carrier in accordance with an embodiment of the present invention.

A front perspective view of carrier 70 showing how the curved lower surface and the opposing planar upper surface of the carrier may meet along a common axis (axis 90) that runs along the peripheral upper edge of device 10 is shown in FIG. 6.

Figure 7:
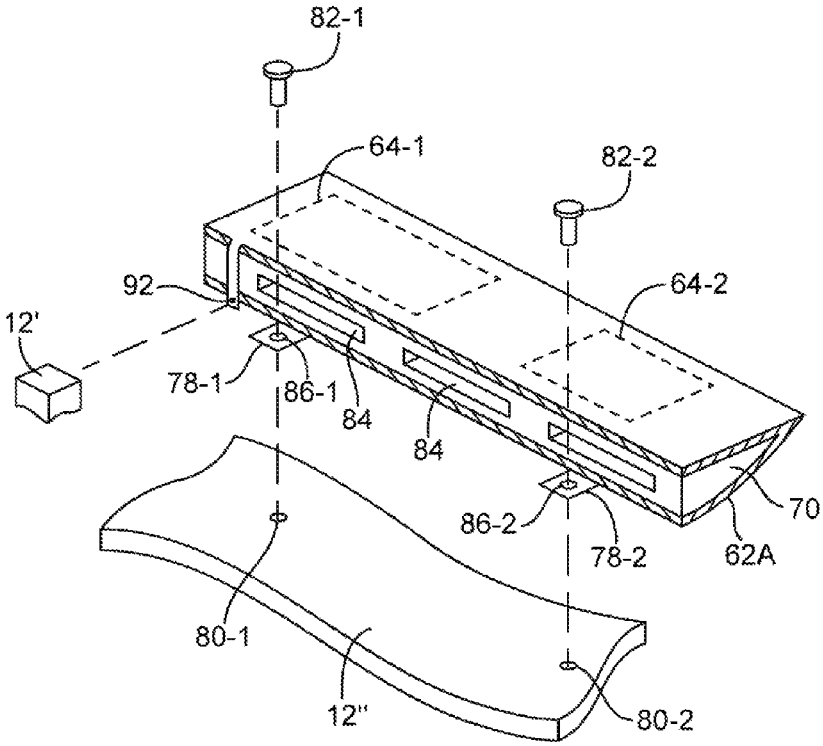
FIG. 7 is an exploded perspective view showing housing portions and fasteners that may be used in mounting an antenna resonating element substrate and carrier within an electronic device in accordance with an embodiment of the present invention.

FIG. 7 is a rear perspective view of carrier 70. A shown in FIG. 7, substrate 62A may be provided with features that help couple transmission lines 44 to the first and second antennas associated with carrier 70. In particular, substrate 62A may have a protrusion having a resonating element trace with a first opening such as opening 86-1. Screw 82-1 may pass through opening 86-1 and may screw into mating screw hole 80-1 in housing portion 12" to ground the trace and form ground antenna terminal 78-1 for the first antenna (e.g., the cellular telephone antenna). A parasitic antenna resonating element that is used to provide the cellular telephone antenna with high band coverage may be coupled to terminal 92. When mounted in device 10, terminal 92 may be grounded to conductive housing portion 12'. Substrate 62A may also have a protrusion with a resonating element trace that has a second opening such as opening 86-2. Screw 82-2 may pass through opening 86-2 and may screw into mating screw hole 80-2 in housing portion 12" to ground the trace and form ground antenna terminal 78-2 for the second antenna (e.g., the satellite navigation system antenna).

Air-filled cavities in carrier 70 such as cavities 84 may facilitate formation of carrier 70 using injection molding techniques.

Figure 8:
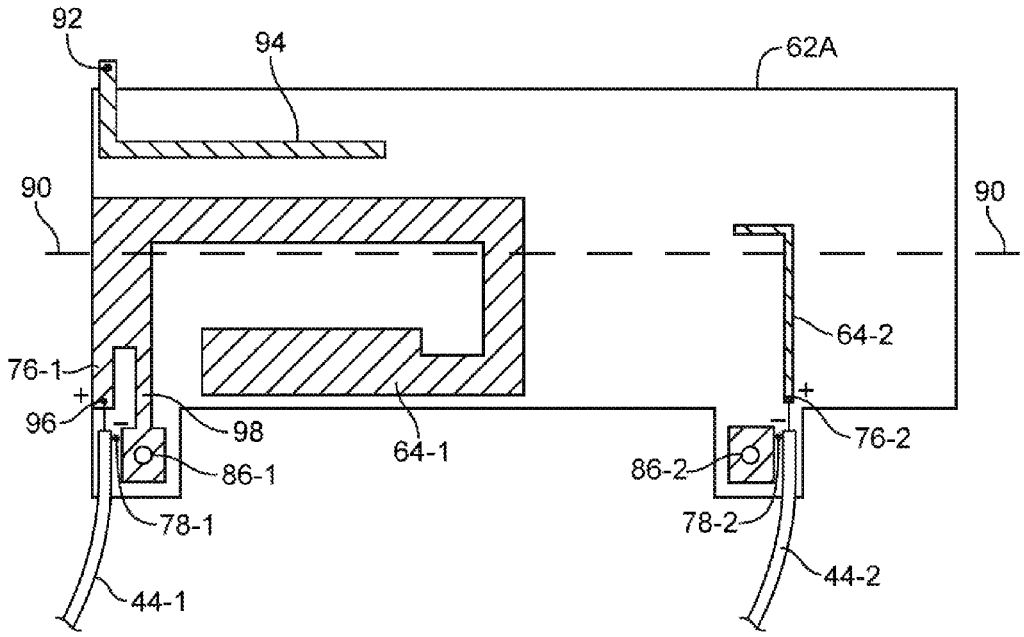
FIG. 8 is a top view of an unwrapped antenna resonating element substrate of the type shown in FIGS. 6 and 7 showing an illustrative pattern of conductive antenna traces that may be used in forming a pair of antennas in accordance with an embodiment of the present invention.

FIG. 8 is a top view of an unwrapped version of substrate 62A, before substrate 62A is mounted to carrier 70. During mounting, substrate 62A is bent along longitudinal axis 90 and is wrapped around carrier 70 so as to cover the planar and curved surfaces of carrier 70.

As shown in FIG. 8, substrate 62A may have an elongated metal trace that forms antenna resonating element 64-2. Antenna resonating element 64-2 may be used to form a satellite navigation antenna resonating element for a satellite navigation antenna (e.g., a Global Positioning System antenna operating at 1575 MHz). Terminal 76-2 may be coupled to one end of the trace for antenna resonating element 64-2. Transmission line 44-1 may have a positive conductor that is coupled to terminal 76-2 and a ground conductor that is coupled to ground terminal 78-2 and the trace on the protruding portion of flex circuit substrate 62A that includes hole 86-2.

At the opposing end of substrate 62A (i.e., the left-hand end in the configuration of FIG. 8), substrate 62A may have a second antenna resonating element trace that is used to form antenna resonating element 64-1. Antenna resonating element 64-1 may be associated with a cellular telephone antenna such as a dual band cellular telephone antenna for receiving voice and non-voice wireless data over cellular telephone networks. Positive antenna feed terminal 76-1 may be coupled to leg 96 of antenna resonating element 64-2. Transmission line 44-1 may have a positive conductor that is coupled to terminal 76-1. Transmission line 44-1 may also have a ground conductor that is coupled to ground terminal 78-1. Ground terminal 78-1 may be formed from the portion of antenna resonating element 64-1 at the end of leg 98 that contains hole 86-1.

Parasitic antenna resonating element 94 may be formed from a strip of conductor (i.e., a patterned metal trace) that is electrically isolated from trace 64-1 on substrate 62A and that is not directly feed by one of transmission lines 44-1 and 44-2. One end of parasitic antenna resonating element 94 may be grounded to housing 12 (i.e., housing portion 12' of FIG. 7) at terminal 92.

Figure 9:
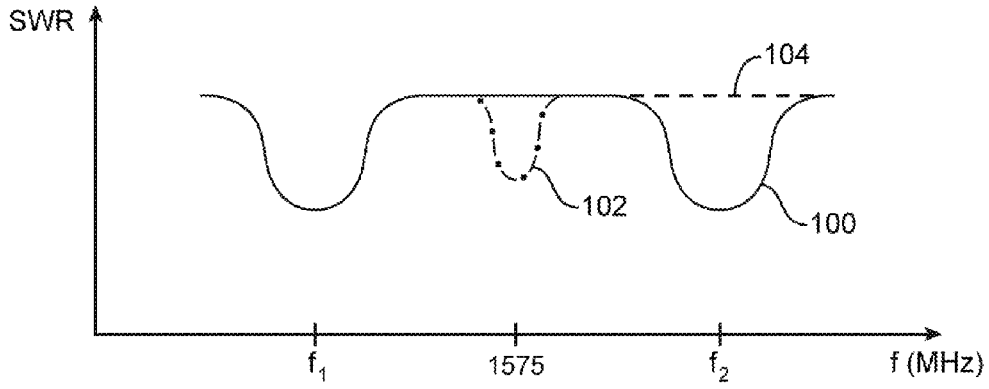
FIG. 9 is a graph in which the standing-wave-ratio for an illustrative pair of antennas such as a cellular telephone antenna and satellite navigation system antenna formed on a substrate of the type shown in FIG. 8 have been plotted as a function of operating frequency in accordance with an embodiment of the present invention.

A graph of the response of the antennas formed using the antenna structures of FIG. 8 is shown in FIG. 9. In the graph of FIG. 9, standing wave ratio (SWR) has been plotted as a function of operating frequency. Solid line 100 shows the response of the cellular telephone antenna formed using antenna resonating element 64-1 and parasitic antenna resonating element 94. As shown by line 100, this antenna may exhibit resonant peaks in a low frequency band centered at frequency f1 (e.g., 850 MHz or 700 MHz or 900 MHz) and a high frequency band centered at frequency f2 (e.g., 1900 MHz or 1800 MHz or 2100 MHz). Dashed line 104 shows how the response of antenna resonating element 64-1 may be poor in the high-band associated with frequency f2 in the absence of parasitic antenna resonating element 94. When parasitic antenna resonating element 94 is present, however, the cellular telephone antenna may exhibit satisfactory response at frequency f2, as illustrated by solid line 100. Line 102 illustrates the response of the second antenna formed on substrate 64A (i.e., the Global Positioning System antenna formed using trace 64-2 of FIG. 8).

If desired, other types of antennas may be formed on substrate 62A. The illustrative arrangement of FIGS. 8 and 9 in which substrate 62A include a cellular telephone antenna and a Global Positioning System antenna is merely illustrative. Moreover, there may be more than two separate antennas formed on a common wrapped flex circuit substrate. The present example involves an arrangement in which first and second antennas have first and second antenna resonating elements that are formed at longitudinally opposing ends of a common wrapped flex circuit substrate. If desired, a common flex circuit antenna resonating element substrate may be used to form three or more antenna resonating elements for three or more respective antennas.

The foregoing is merely illustrative of the principles of this invention and various modifications can be made by those skilled in the art without departing from the scope and spirit of the invention.

What is claimed is:

1. An electronic device antenna structure, comprising:

a plastic support structure having opposing first and second surfaces, wherein the first surface comprises a planar surface and wherein the second surface comprises a curved surface that opposes the planar surface;

an antenna resonating element substrate having first and second antenna resonating elements for first and second respective antennas, wherein the antenna resonating element substrate is wrapped around the plastic support structure and covers the first and second surfaces, the planar and curved surfaces meet along an axis, the first antenna resonating element and the second antenna resonating element on the antenna resonating element substrate are each bent over the axis by at least 90 degrees, the first and second antenna resonating elements each have respective first portions on the first surface that extend in a direction parallel to the axis and each have respective second portions on the second surface that extend from the first portions, a segment of the second portion of the first antenna resonating element extends parallel to the axis, and the segment is located at a greater distance from the axis than the first portion of the first antenna resonating element;

a first antenna feed coupled to the first antenna resonating element at the second surface; and a second antenna feed coupled to the second antenna resonating element at the second surface.

2. The electronic device antenna structure defined in claim 1 further comprising a parasitic antenna resonating element on the antenna resonating element substrate that forms part of the first antenna.

3. The electronic device antenna structure defined in claim 2 wherein the parasitic antenna resonating element structure comprises a strip of conductor having a terminal that is connected to an electronic device housing.

4. The electronic device antenna structure defined in claim 2 wherein the first antenna is configured to operate in first and second cellular telephone communications bands.

5. The electronic device antenna structure defined in claim 4 wherein the second antenna is configured to operate in a satellite navigation system band.

6. The electronic device antenna structure defined in claim 1 wherein the antenna resonating element substrate comprises a flexible sheet of polymer that is attached with adhesive to the first and second surfaces.

7. The electronic device antenna structure defined in claim 1 wherein the axis runs along a longitudinal dimension of the antenna resonating element substrate, wherein the antenna resonating element substrate has first and second longitudinally opposing ends, wherein the first antenna resonating element is located at the first end, and wherein the second antenna resonating element is located at the second end.

8. An electronic device, comprising:

a dielectric carrier having opposing first and second surfaces;

a flexible antenna resonating element substrate that covers at least some of the first and second surfaces;

a conductive housing that forms an antenna ground;

a first antenna resonating element on the flexible antenna resonating element substrate, wherein the antenna ground and the first antenna resonating element form a first antenna; and a second antenna resonating element on the flexible antenna resonating element substrate, wherein the antenna ground and the second antenna resonating element form a second antenna; and a display with a cover glass layer, wherein the antenna resonating element substrate on the first surface of the dielectric carrier lies alongside the cover glass layer, a first portion of the first antenna resonating element is located on the flexible antenna element substrate on the first surface of the dielectric carrier, a second portion of the first antenna resonating element is located on the flexible antenna element substrate on the second surface of the dielectric carrier, a third portion of the second antenna resonating element is located on the flexible antenna element substrate on the first surface of the dielectric carrier, a fourth portion of the second antenna resonating element is located on the flexible antenna element substrate on the second surface of the dielectric carrier, the first portion extends perpendicularly from the second portion, and the third portion extends perpendicularly from the fourth portion.

9. The electronic device defined in claim 8 further comprising a dielectric window in the conductive housing, wherein the carrier is mounted adjacent to the dielectric window.

10. The electronic device defined in claim 8 wherein the first surface comprises a planar surface and wherein the dielectric carrier is mounted so that the planar surface lies alongside the cover glass layer.

11. The electronic device defined in claim 10 wherein the display has an active area that is surrounded by a peripheral inactive area, wherein an inner surface of the cover glass layer in the peripheral inactive area is covered with an opaque masking layer, and wherein the planar surface is covered by the opaque masking layer.

12. The electronic device defined in claim 11 further comprising a dielectric window in the conductive housing, wherein the dielectric window has a curved shape and wherein the second surface is curved to match the curved shape of the dielectric window.

13. The electronic device defined in claim 8 further comprising a parasitic antenna resonating element on the flexible antenna resonating element substrate adjacent to the first antenna resonating element, wherein the parasitic antenna resonating element forms part of the first antenna.

14. The electronic device defined in claim 13 further comprising a dielectric window, wherein the dielectric carrier is interposed between the cover glass layer and the dielectric window, wherein the the first and second antennas are configured to receive the radio-frequency signals through the cover glass layer and the dielectric window.

15. Apparatus, comprising:

a dielectric carrier having first and second surfaces that meet along an axis;

a flexible antenna resonating element substrate wrapped around the dielectric carrier covering the first and second surfaces and having first and second antenna resonating elements that form first and second antennas; and a cover glass layer, wherein a first portion of the first antenna resonating element is located on a portion of the flexible antenna resonating element substrate that is interposed between the cover glass layer and the first surface of the dielectric carrier, a second portion of the second antenna resonating element is located on the portion of the flexible antenna resonating element substrate that is interposed between the cover glass layer and the first surface of the dielectric carrier, a third portion of the second antenna resonating element is located on a portion of the flexible antenna resonating element that covers the second surface of the dielectric carrier, the first portion and the second portion extend parallel to the axis, and the third portion extends from an end of the second portion.

16. The apparatus defined in claim 15 wherein the first and second surfaces meet along an axis, wherein the flexible antenna resonating substrate is bent over the carrier along the axis, and wherein the flexible antenna resonating element substrate covers the first and second surfaces.

17. The apparatus defined in claim 16 further comprising a parasitic antenna resonating element on the flexible antenna resonating element substrate that forms part of the first antenna.

18. The apparatus defined in claim 17 wherein the first antenna is configured to operate in at least two cellular telephone communications bands and wherein the second antenna is configured to operate in a satellite navigation system band.

19. The electronic device antenna structures defined in claim 1, wherein the first antenna resonating element and the second antenna resonating element on the antenna resonating element substrate are each bent over the axis by greater than 90 degrees.

20. The electronic device defined in claim 10, further comprising:

a parasitic antenna resonating element formed on the flexible antenna resonating element substrate on the planar surface that lies alongside the cover glass layer, wherein the parasitic antenna resonating element is grounded to the conductive housing; and a dielectric window in the conductive housing, wherein the dielectric window has a curved shape, wherein the second surface of the dielectric carrier comprises a continuously curved surface, wherein a portion of the first antenna resonating element is formed on the flexible antenna resonating element substrate on the continuously curved surface, wherein a portion of the second antenna resonating element is formed on the flexible antenna resonating element substrate on the continuously curved surface, and wherein the continuously curved surface is curved to match the curved shape of the dielectric window.

* * * * *